United States Patent [19]

Miller

[11] Patent Number: 4,830,088

[45] Date of Patent: May 16, 1989

[54] METHOD AND APPARATUS FOR CONTROLLING SOLIDIFICATION OF CAST METAL BAR

[75] Inventor: Vernon J. Miller, Carroll County, Ga.

[73] Assignee: Southwire Company, Carrollton, Ga.

[21] Appl. No.: 178,171

[22] Filed: Apr. 6, 1988

[51] Int. Cl.[4] ..... B22D 11/06; B22D 11/07

[52] U.S. Cl. ..... 164/472; 118/47; 164/433; 164/482; 427/423

[58] Field of Search ..... 164/482, 472, 72, 433, 164/434; 118/47, 315, 318; 427/423

[56] References Cited

U.S. PATENT DOCUMENTS

| | | | |
|---|---|---|---|
| 1,543,085 | 6/1925 | Anderson | 118/47 |
| 3,322,184 | 5/1967 | Cofer et al. | 164/482 X |
| 3,916,984 | 11/1975 | Properzi | 164/433 X |

FOREIGN PATENT DOCUMENTS

| | | | |
|---|---|---|---|
| 57-36044 | 2/1982 | Japan | 164/482 |
| 57-168751 | 10/1982 | Japan | 164/482 |
| 59-64137 | 4/1984 | Japan | 164/482 |
| 59-189048 | 10/1984 | Japan | 164/472 |

*Primary Examiner*—Nicholas P. Godici
*Assistant Examiner*—J. Reed Batten, Jr.
*Attorney, Agent, or Firm*—James W. Wallis, Jr.; Stanley L. Tate

[57] ABSTRACT

A method and apparatus apply an insulating layer of carbon to individual faces of the continuously rotating mold surface of a wheel and belt type casting machine, utilizing separately controllable and directable soot applicators to selectively vary the heat transfer characteristics of the individual mold surfaces.

9 Claims, 2 Drawing Sheets

METHOD AND APPARATUS FOR CONTROLLING SOLIDIFICATION OF CAST METAL BAR

TECHNICAL FIELD

This invention relates generally to the production of copper-base products, and more particularly to a method of producing hot formed copper-base products from molten metal.

BACKGROUND ART

In casting hot-formed copper-base products it is desirable to control the grain structure within the cast bar. Some applications call for a product having fine equiaxed grains with no grain alignment, while others may be suitably produced having a defined dendritic structure.

These grain structures may be obtained during the solidification of molten metal while closely controlling the solidification parameters.

In the casting operation known as wheel and belt casting, molten metal is fed into a groove cut into the periphery of a circular mold, a flat belt being pressed around a portion of the periphery of said mold forms the solidification chamber. Molten metal is fed into the mold at the point where the flat belt first contacts the wheel, with solidification taking place as heat is removed from the molten metal by the mold.

The rate at which heat is removed from the molten metal is controlled by a number of variables. One of these variables is the location of cooling water or cooling spray applied to the mold itself. Another variable is the quantity of cooling liquid applied to the mold, and still another variable being the placement and rate of application of cooling liquid applied to the belt forming the cavity.

A cross section of the casting ring or casting mold reveals it to be basically a U-shaped mold with approximately equal mass on three sides. This mold is typically made of a copper or copper based alloy and is an excellent heat conductor. The belt used to enclose the U-shaped mold and create the closed side of the casting cavity is typically a thin steel band. Steel is a much poorer conductor of heat than copper. For these reasons, it may readily be seen that molten metal contained on three sides by a thick, high heat transferring mold medium and on the fourth side by a thin, poor heat transferring medium, a non-uniform rate of heat removal would be expected from the four sides of the molten metal. In an alloy or nearly pure copper product in which an equi-axed grain structure is obtained, this non-equal removal of heat from the molten metal is not critical. However, in a cast bar having a columnar or dendritic grain structure, it is most desirable that heat is removed from the metal at approximately equal rates from opposite sides of the bar. That is, the removal of heat from the left and right side of the cast bar should be approximately equal, and the heat removed from the upper and lower side of the bar should be equal. This will cause the dendrites to grow at an equal rate, thereby completing the solidification process at approximate the center of the cast bar. If the bar were perfectly square, the dendritic pattern would appear to grow equally from all four sides to a point in the center of the bar. In the situation where the bar is wider than it is tall, the dendritic solidification pattern will appear to be a small triangular shaped dendritic pattern pointing toward the center of the bar from each of the two short sides and a trapezoidal shaped dendritic pattern growing from each of the two long sides resulting in a long straight interface between the dendritic grains growing from the two longer solidification fronts.

As noted before, the equal removal of the heat, absent some means of modifying the natural heat removal in the above described system, is not readily obtained. Heat will be removed from the three sides bound by the heavy copper mold at a faster rate than will be removed through the thin metal band. This will result in the solidification interface being shifted much to the band side of the copper cast bar with a very short line of dendrites on the band side and extremely long dendrites having grown from the copper wheel side. This results in a copper bar whose dendritic pattern is not symmetrical and whose working characteristics will not be desirable.

SUMMARY OF THE INVENTION

The method and apparatus of the present invention are directed toward correcting the above shortcomings in the above described system. While it would be impossible to direct cooling spray to one side or the other of the heavy copper mold and create a different rate of heat extraction from the different sides of the molten metal, it is possible to insulate the molten metal from portions of the copper mold to different degrees, thereby resulting in a change of solidification rate on that mold surface. The present invention deals with such a method and apparatus.

Prior to the introduction of molten metal into the casting chamber, a layer of carbon, or soot, is applied to the surfaces of the circular copper mold. Carbon is not soluble in molten copper. Therefore, a layer of carbon on the mold surface will not be dissolved by the molten copper thereon placed, and the layer of carbon serves a two fold purpose. The first purpose it will serve is to act as a lubricant for the bar being cast in said mold. This allows for the easy removal of the bar from the mold upon solidification. The second purpose of this layer of carbon is that of a heat insulator. A layer of carbon on the mold surface will act as a heat barrier, that is a medium that will slow the rate of heat transfer from the molten copper to the solid copper mold. This layer of carbon, when placed on the three mold surfaces defined by the copper casting ring, retards the flow of heat such that it can be matched to that of the steel band forming the fourth side of the casting cavity. By varying the thickness of the layer of carbon applied, one may control the rate of solidification attributable to that portion of the mold so coated. A balance can be obtained whereby an equalization of the rate of heat removal from the band and wheel surfaces are obtained. It is therefore possible to obtain a structure of columnar grains being equal in length when measured from opposite sides of the cast bar.

There have been many attempts made to devise an ideal method of applying a coat of carbon to the mold surface. Early attempts included suspensions of carbon particles in a volatile carrier, said suspension applied to the mold surface and heated. The disadvantage to this method is the lack of consistent removal of the volatile carrier. Should any of the volatile liquid carry over to the point where molten copper enters the mold, the volatile liquid will create gas pockets in the surface of the cast copper bar.

Another more acceptable method of applying a layer of carbon to the mold surface consists of directing a fuel rich hydrocarbon flame toward the mold surface. One suitable hydrocarbon used for this purpose is acetylene gas. An acetylene rich gas flame directed toward the mold surface will apply a layer of carbon thereon. This has been the standard industry practice for many years. However, the typical application of carbon through the use of this gas is accomplished by directing a flare tip burner to the center of the groove in the casting ring. The thickness of the layer of carbon being deposited was controlled by the rate of gas fed through the burner. This application of carbon to the mold surface is vulnerable to inconsistencies due to a build up of carbon on the burner tip as well as any external influences blowing or causing the flame to strike the mold in other than a symmetrical manner.

The results of this non-uniform application of carbon to all of the mold surface results in a variation of the dendritic growth obtained when the metal solidifies in a mold so coated. The apparatus of the present invention overcomes these objections.

In the present invention, the carbon application apparatus consists of a three segment applicator, each being directed toward a different surface of the casting ring groove. Each segment is individually fed and controlled, thereby allowing the operator to place a predetermined coating of carbon on any given mold surface. By being able to control the thickness of the insulating carbon layer on each of the three mold faces, the operator can adjust the gas supplies and obtain a perfectly symmetrical arrangement of the copper dendrites within the cast bar.

BEST MODE FOR CARRYING OUT THE INVENTION

Figure 1:
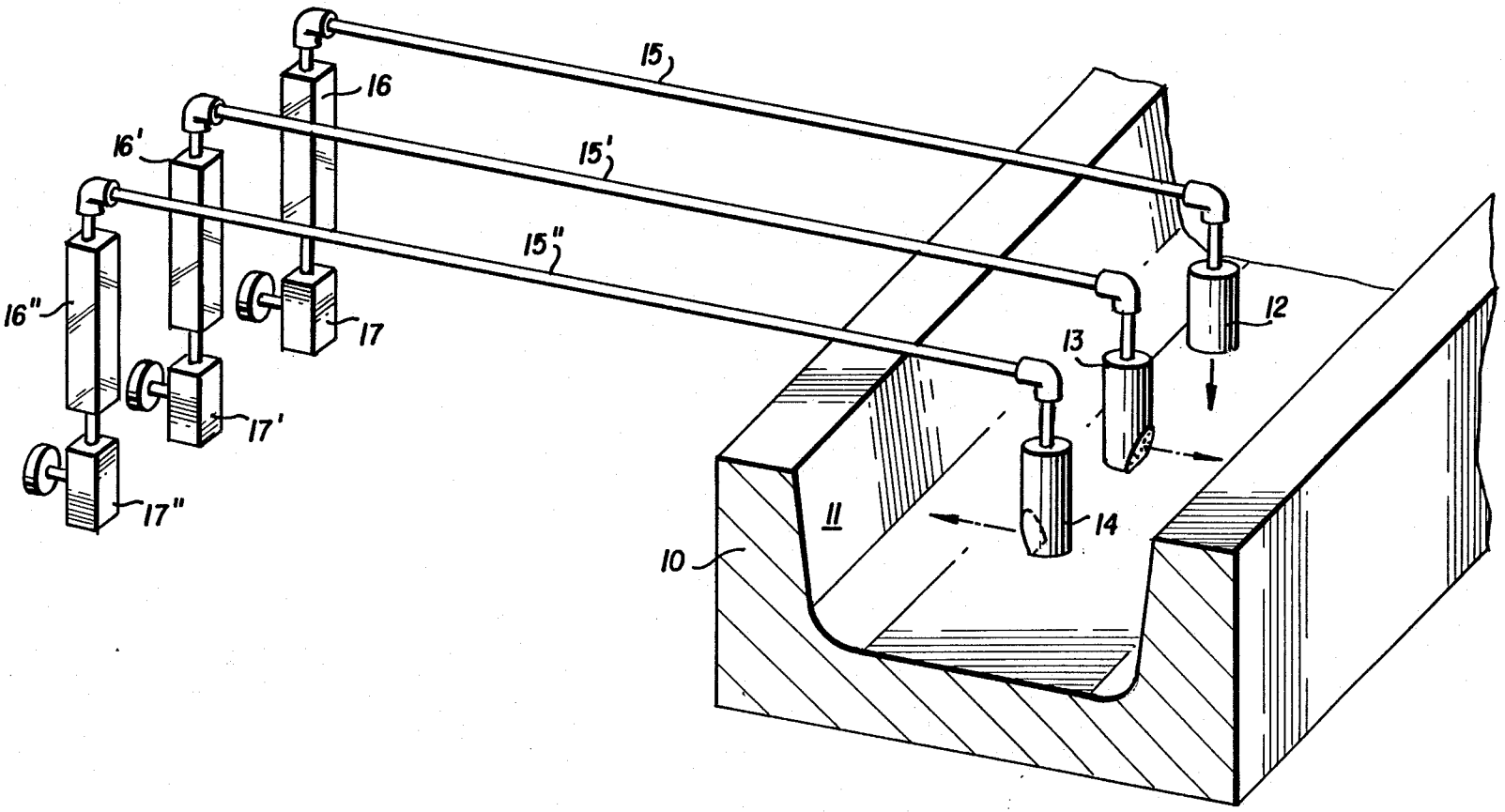
FIG. 1 is a view of the present invention, showing the relative positioning of the elements of the apparatus utilizing three individual burner tips.

Refer now to FIG. 1, which shows the present invention utilizing a plurality of applicator tips. A fuel rich mixture of acetylene and air is passed through valve 17. Said mixture then passes through flow meter 16 where flow rates can be measured. Said mixture continues through pipe 15 and through applicator tip 12. Applicator tip 12 directs said burning mixture onto one face of groove 11 in mold 10. A similar gas mixture passes through valve 17' passing through flow meter 16', pipe 15', and applied to a second face of groove 11 in mold 10 by applicator tip 13.

Likewise, said mixture passing through valve 17'', through flow meter 16'', and pipe 15'', is applied to the third face of groove 11 in mold 10 by applicator tip 14. Valves 17, 17', and 17'' are independently adjustable so that applicator tips 12, 13, and 14, respectively, may be utilized to apply individually selected thicknesses of carbon to each of the three mold faces of groove 11 in mold 10.

Figure 2:
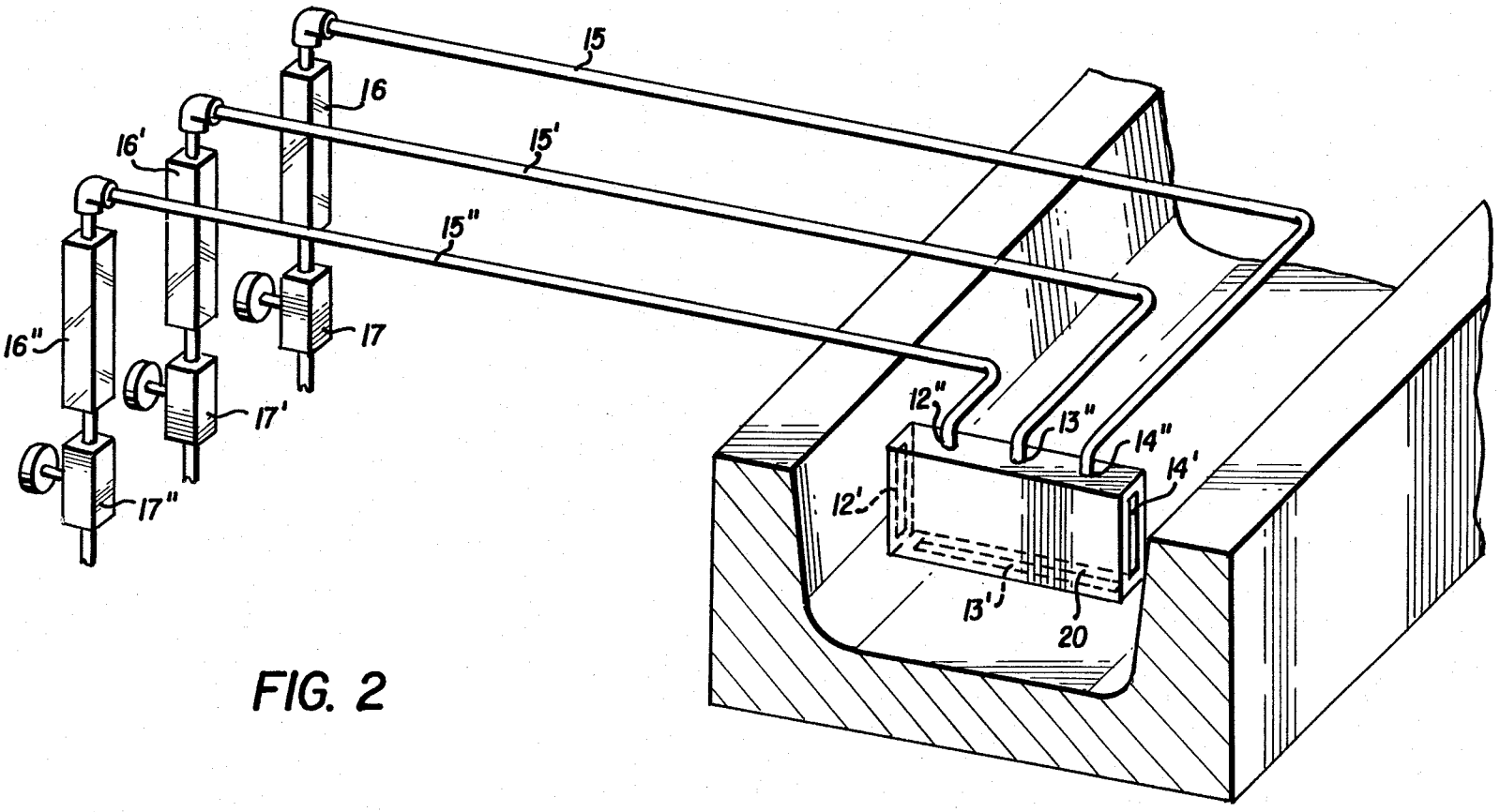
FIG. 2 is a view of the present invention showing the relative positioning of the apparatus utilizing a single, but segmented, applicator tip.

Refer now to FIG. 2, which is an example of the present invention utilizing a single, but segmented applicator tip. An acetylene rich mixture is passed through valve 17. Said mixture passes through flow meter 16, where its flow is monitored. It then passes through pipe 15 where it is introduced into segmented applicator tip 20 at entrance 14''. Said entrance 14'' supplies fuel for applicator slot 14' which applies carbon to one face of groove 11 in mold 10. Similarly, a gas rich mixture passes through valve 17', through flow meter 16', where the flow rate of said mixture is measured. Said mixture then passes through pipe 15' where it is fed through entrance 13'' of applicator tip 20. Entrance 13'' supplies the fuel mixture for applicator slot 13', which applies carbon to a second face of groove 11 in mold 10. And likewise, a gas rich mixture is passed through valve 17'', through flow meter 16'', where its flow is monitored. Said mixture then passes through pipe 15'' through entrance 12'' of segmented applicator tip 20. Entrance 12'' supplies fuel for applicator slot 12'. The application of carbon from applicator slot 12' coats the remaining face of groove 11 in mold 10.

Although the present invention has been discussed and described with primary emphasis on one preferred embodiment, it should be obvious that adaptations and modifications can be made thereto without departing from the spirit and scope of the invention.

What is claimed is:

1. Controlling the rate of solidification of a continuously cast metal bar in a mold defined by a casting belt and a wheel having a groove, comprising:

applying an insulating soot layer to the molten metal contacting surface of said mold by employing a plurality of burner nozzles, each burner nozzle being directed at a different surface of the wheel defining the groove and each burner nozzle being individually controllable;

filling said mold with molten metal; and cooling said mold.

2. The method of claim 1, wherein applying a layer of soot to the surface of said mold defined by a casting belt and a wheel having a groove comprises:

feeding combustible gas to said plurality of burner nozzles;

measuring the flow of said combustible gas being fed to said nozzles; and controlling the flow of said combustible gas passing through said nozzles.

3. The method of claim 2, wherein a flow meter measures the delivery rate of said combustible gas to each individual nozzle.

4. The method of claim 2, wherein a control means adjusts the flow of said combustible gas to each individual nozzle.

5. The method of claim 2, wherein combustible gas feeding each burner nozzle is individually monitored with its own flow meter.

6. The method of claim 2, wherein each nozzle is provided with its own individual combustible gas control valve.

7. The method of claim 2, wherein each said nozzle applies a layer of soot to a different surface of said mold.

8. A method of continuously casting a molten metal in a mold defined by a casting belt and a wheel having a groove, comprising:

applying a layer of soot employing a plurality of burner nozzles by providing a supply of combustion gas to each said burner nozzle, each burner nozzle being directed at a different surface of the wheel defining the groove and each burner nozzle being individually controllable;

providing a measuring means for measuring the flow of said combustion gas to each said burner nozzle; and providing a control means for individually controlling the flow of said combustion gas to each said burner nozzle.

9. An apparatus for continuously applying a layer of soot to the mold surface of a mold defined by a casting belt and a wheel having a groove, comprising:

a plurality of burner nozzles, each burner nozzle being directed at a different surface of the wheel defining the groove and each burner nozzle being individually controllable;

a supply of combustion gas to each said burner nozzle;

a measuring means for measuring the flow of said combustion gas to each said burner nozzle; and a control means for individually controlling the flow of said combustion gas to each said burner nozzle.

* * * * *